US006276577B1

(12) United States Patent
Migliorini

(10) Patent No.: US 6,276,577 B1
(45) Date of Patent: Aug. 21, 2001

(54) METHOD AND APPARATUS FOR HANDLING TEXTILE ARTICLES, ESPECIALLY FOR LOADING ARTICLES ON HOSIERY MACHINES

(75) Inventor: Pier Lorenzo Migliorini, Arezzo (IT)

(73) Assignee: Matec S.p.A. (IT)

( * ) Notice: Subject to any disclaimer, the term of this patent is extended or adjusted under 35 U.S.C. 154(b) by 0 days.

(21) Appl. No.: 09/320,311

(22) Filed: May 26, 1999

(30) Foreign Application Priority Data

May 27, 1998 (IT) ..... FI98A0126

(51) Int. Cl.[7] ..... A47G 27/90
(52) U.S. Cl. ..... 223/112; 223/1
(58) Field of Search ..... 223/112, 75, 1, 223/111, 77, 52

(56) References Cited

U.S. PATENT DOCUMENTS 4,539,924 9/1985 Bell, Jr. et al. .
4,881,477 11/1989 Gazzarini .

FOREIGN PATENT DOCUMENTS 0 306 460 3/1989 (EP) .
0 508 014 A2 10/1992 (EP) .
0 508 014 B1 10/1992 (EP) .
0 521 206 A1 1/1993 (EP) .
2 103 257 2/1983 (GB) .

*Primary Examiner*—Bibhu Mohanty
(74) *Attorney, Agent, or Firm*—McGlew and Tuttle, P.C.

(57) ABSTRACT

An apparatus for handling textile articles with structure to engage a portion 30 of the articles in a station for removal thereof and to operate the handling thereof in a predetermined direction F up to a station for either the unloading or the release thereof. A rotation body 6 acts between the removal and handling means and the article portion 30 is engaged by the latter, in order to move the article portion forward by rotating it in the direction F about a respective fold axis u—u. The rotation body 6 is in an active condition in correspondence of the unloading of the articles 3 and, respectively in a rest condition in correspondence of the removal and handling thereof.

8 Claims, 10 Drawing Sheets

METHOD AND APPARATUS FOR HANDLING TEXTILE ARTICLES, ESPECIALLY FOR LOADING ARTICLES ON HOSIERY MACHINES

FIELD OF THE INVENTION

The present invention refers to a method and apparatus for handling textile articles, especially for loading articles on hosiery machines.

BACKGROUND OF THE INVENTION

One of the problems of great concern in the processing of textile articles is the holding or gripping of these same articles during steps or stages which provide for the transfer of the articles between a plurality of work stations or within a same station.

For example, in the stocking-manufacturing sector, this problem relates, particularly, to the operations for turning the stockings inside-out on toe-seaming machines, so-called "toe-closers" and, more generally, to the automatic loading of stockings support members in assembly-line machines for the formation of pantyhose articles.

The devices known at present for the loading of hoses in toe-closer machines, provide for picking up the stockings held in correspondence of their elastic hem and transferring them thus held, onto the hoses wherein the toe of the articles is introduced to allow them to be turned inside-out afterwards. Following this operation, the article results most of the time with the portion of their elastic hem being folded up and this may result that, after the seaming of the toe, the article is inaccurately removed from the toe-closer's hoses and incorrectly positioned onto the shapes of machines, such as the line-closers, which occurs during the successive assembly steps for the manufacturing of pantyhose articles.

U.S. Pat. No. 4,539,924, EP 521206 and EP 508014 documents disclose devices for the automatic loading of articles on toe-closers and on assembling machines for pantyhose formation.

The devices disclosed in the above documents exhibit basically a plurality of article gripping members in correspondence of the elastic hem. The members are mounted on a support movable between a station for gripping the articles unloaded from a device which set them in a predetermined orientation, and a release station in correspondence of the machine receiving these articles.

These documents do not teach how to overcome the above mentioned drawback.

SUMMARY AND OBJECTS OF THE INVENTION

The main object of the present invention is to propose an apparatus for optimizing the processes in the textile industry for handling articles to be displaced between a plurality of stations or between machines or devices of a same station.

This result has been achieved, according to the invention, by providing an apparatus including a transport body holding the article in a folded state about a fold axis. The carriage is movable between first and second stations. An engagement element arranged on the transport body engages a portion of the article at the first station. The transport means moves the article to a second station where a rotation device mounted on the transport body rotates the portion of the article about the fold axis. The method used by the present invention includes gripping the elastic hem of the article at the first station and then moving the article with the gripped elastic hem away from the first station and to a second station. At the second station, the elastic hem is ungripped or disengaged. The rotation device then engages and moves the elastic hem at said second station to rotate any folded portion of the hem about the fold axis of the folded portion. Further characteristics being set forth in the dependent claims.

The present invention makes it possible to always ensure the most correct grip and handling of articles, such as stockings for example, which require to be suitably moved during the operations for their manufacturing.

The apparatus according to the invention is easy to make, cost-effective, reliable even after a prolonged service life, easily installable on existing stocking-feeding lines and able to operate in a fully automatic fashion.

These and other advantages and characteristics of the invention will be best understood by anyone skilled in the art from a reading of the following description in conjunction with the attached drawings given as a practical exemplification of the invention, but not to be considered in a limitative sense.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1A:
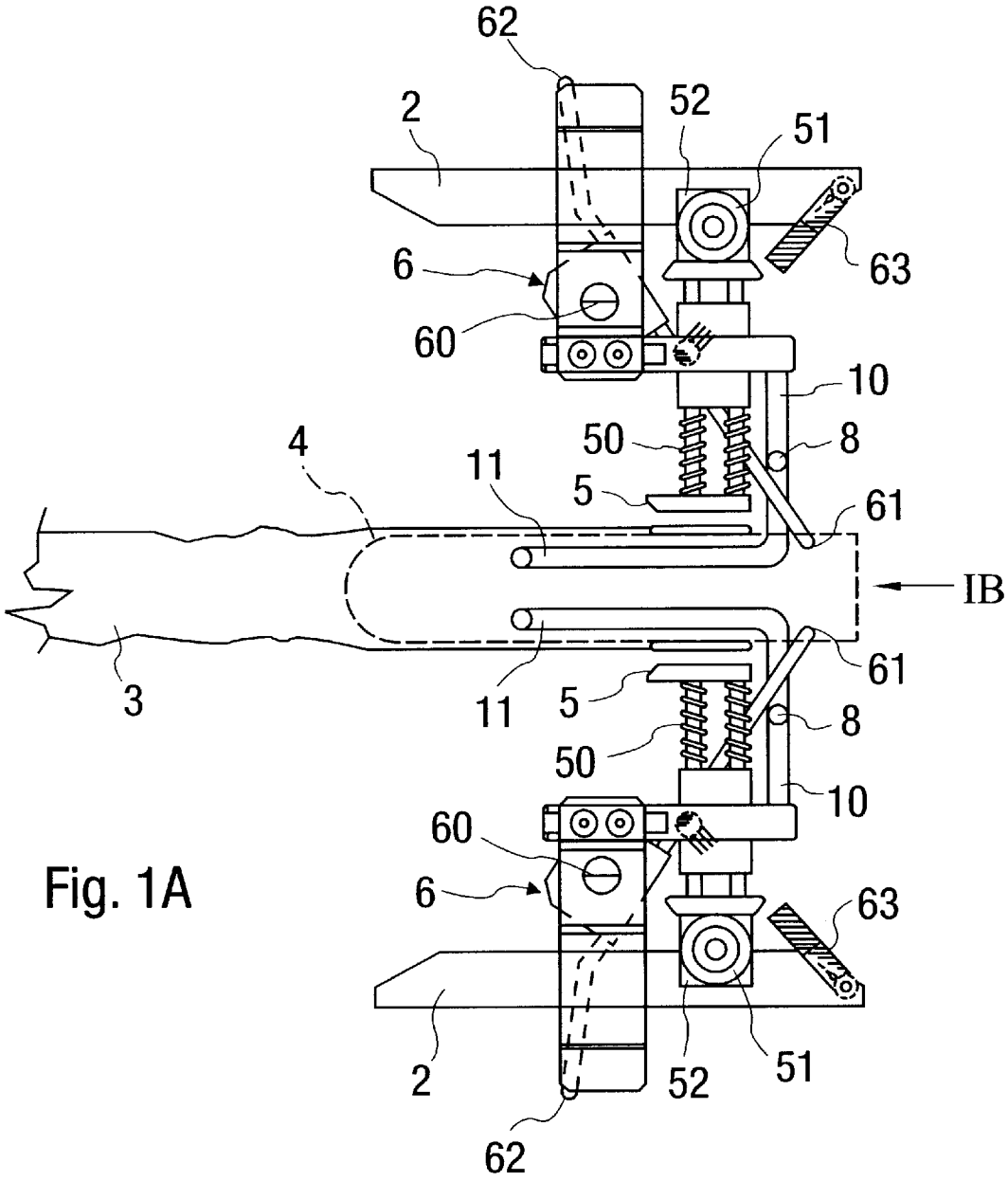
FIG. 1A is a schematic view in longitudinal section of an apparatus, according to the invention, as it picks up a stocking by the elastic hem of the latter.
Figure 1B:
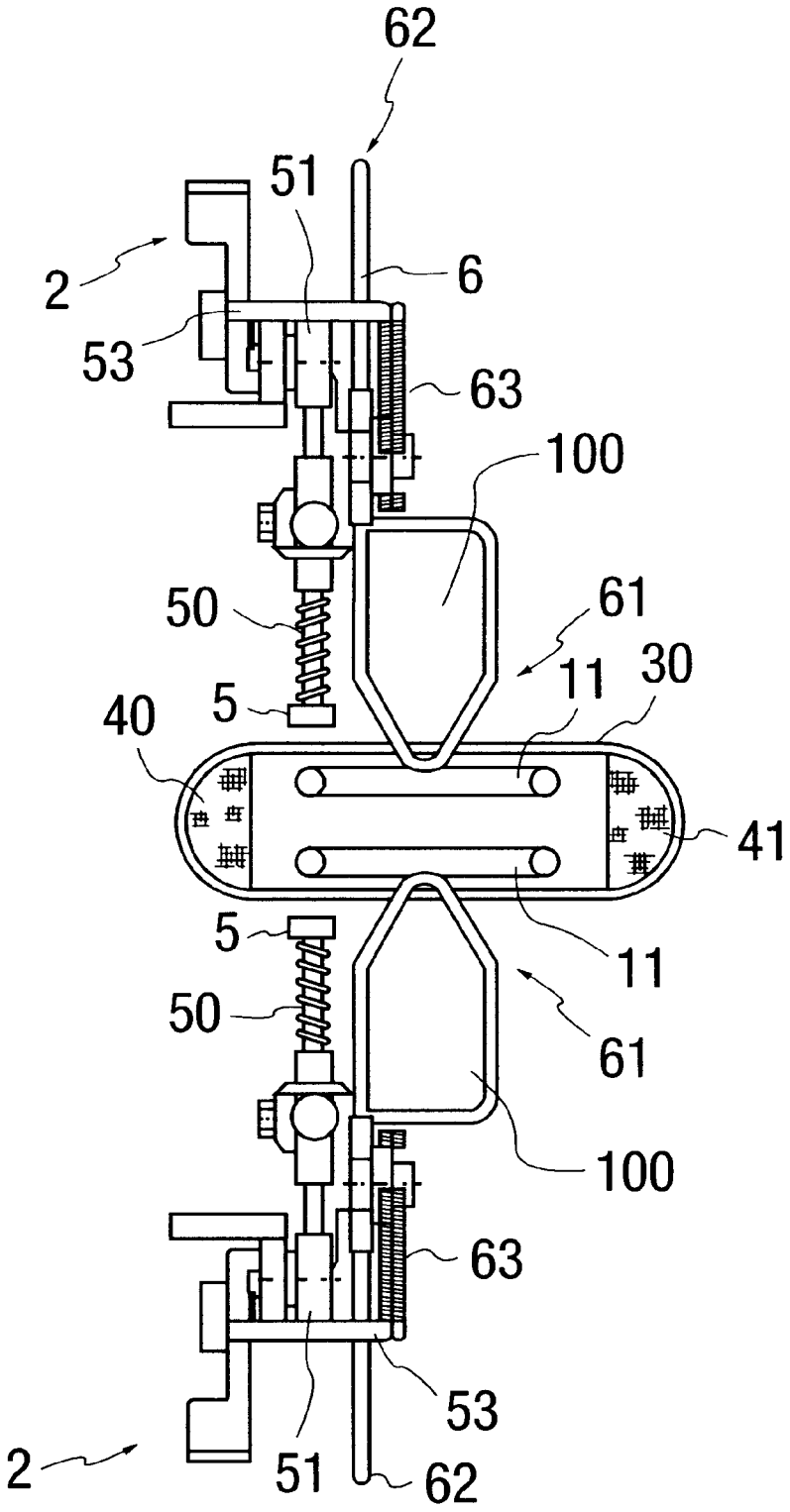
FIG. 1B is a view from "IB" of the apparatus of FIG. 1A.
Figure 2A:
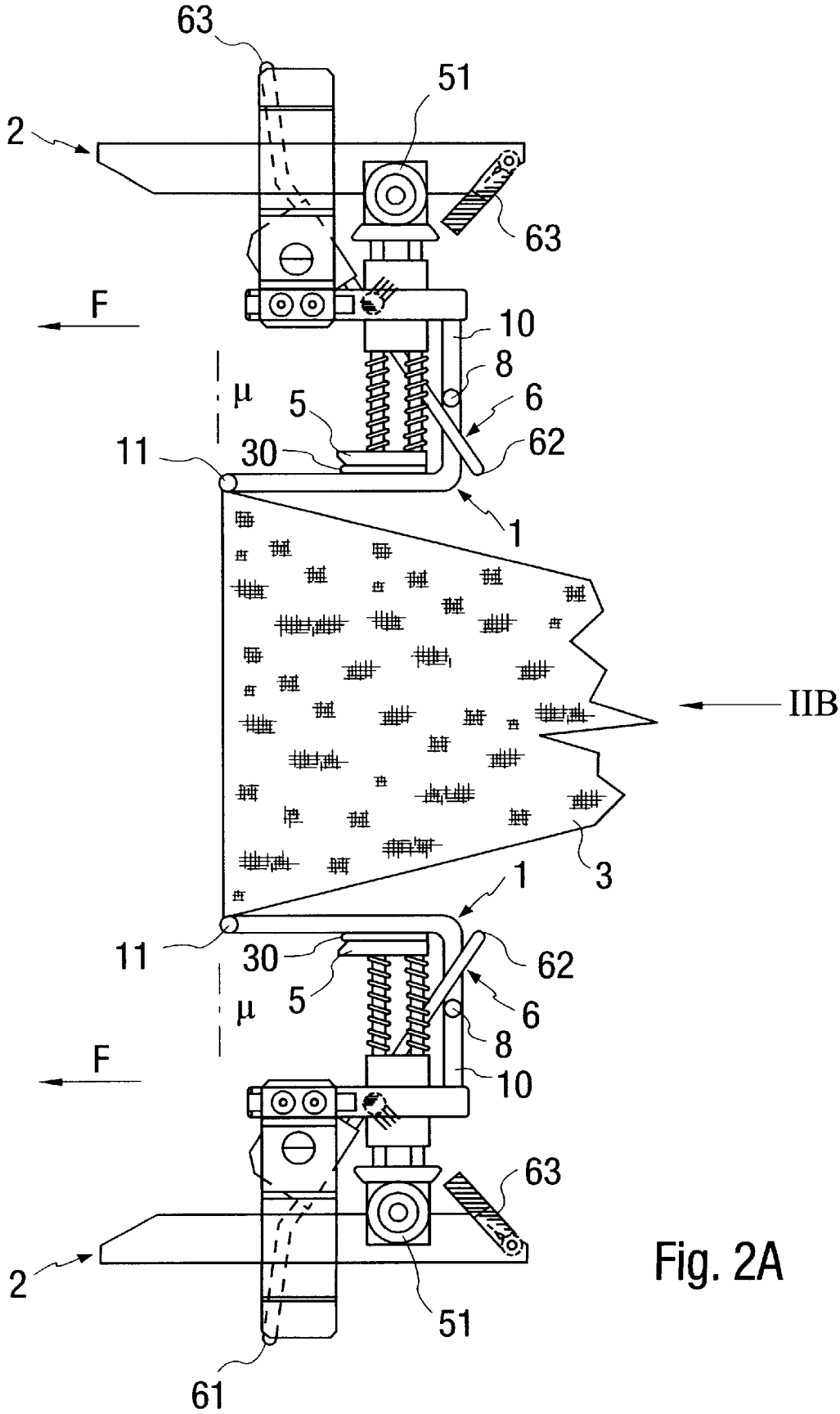
FIG. 2A is a view of the apparatus shown in the preceding figures as it moves the stocking in the direction of arrows "F"

Referring to the drawings, an apparatus according to the invention comprises at least two rigid L-bent engagement elements 1, as shown in FIG. 2A, positioned opposite to each other. Each of the L-bent engagement elements 1 has a substantially vertical portion 10 solid to a transport body means 2 and has a substantially horizontal portion 11, which is the extension of the respective vertical portion 10. The substantially horizontal portions 11 are introduced into the stocking 3 in progress through the elastic hem 30 of the stocking 3. The elastic hem 30 of the stocking 3 may be stretched apart beforehand by means of a retractor 4, see FIG. 1A, consisting of a segment able to be opened up in two parts 40, 41, as illustrated in FIG. 1B, and on which the stocking's elastic hem is fitted in advance by pneumatic suction. The Italian Patent Application FI 97 A 135 discloses in more detail a retractor of this type.

The transport body means 2 for transporting the engagement elements 1 comprise, according to the example illustrated in the drawings for each engagement element 1, a plate with appendix 20 hinged to a loop-closed chain 21 which develops in a plane parallel to direction F of motion of the stocking 3. Each of said elements 1 associated with a corresponding carriage of the transport body means 2 is therefore movable in the direction F of motion of the stocking 3, so that the carriages 2 of opposite engagement elements 1 will result, in turn, located on opposite sides of the stocking 3 to be treated—as illustrated in FIGS. 4D—4D. The two chains 21 extend throughout the area of motion of the stockings 3 to be treated and are mounted on relevant arms 210 angularly oscillating about respective axes 211 orthogonal to the direction F of motion of the stocking 3. This allows the carriages 2 to move to and from the retractor 4 within the area of engagement of the stocking 3—as indicated by the arrows G and H in FIGS. 4A and 4B. The rotation of said arms 210 about the respective axes 211 is achieved by means of relevant actuators not shown in the figures of the attached drawings.

Associated to each carriage 2 is a presser 5 facing the horizontal portion 11 of the corresponding element 1. The presser 5 is associated with a spring means 50 which acts on the presser 5 to keep the presser 5 compressed on the elastic hem 30 of the article 3, that is on the horizontal portion 11 of the respective element 1. In this way, the assembly 1, 5 of each carriage 2 makes up a normally closed gripper able to engage, that is to compress and hold, the elastic hem 30 upon the removal and handling stage thereof, as well as to disengage the hem 30 upon the release stage thereof.

Figure 4A:
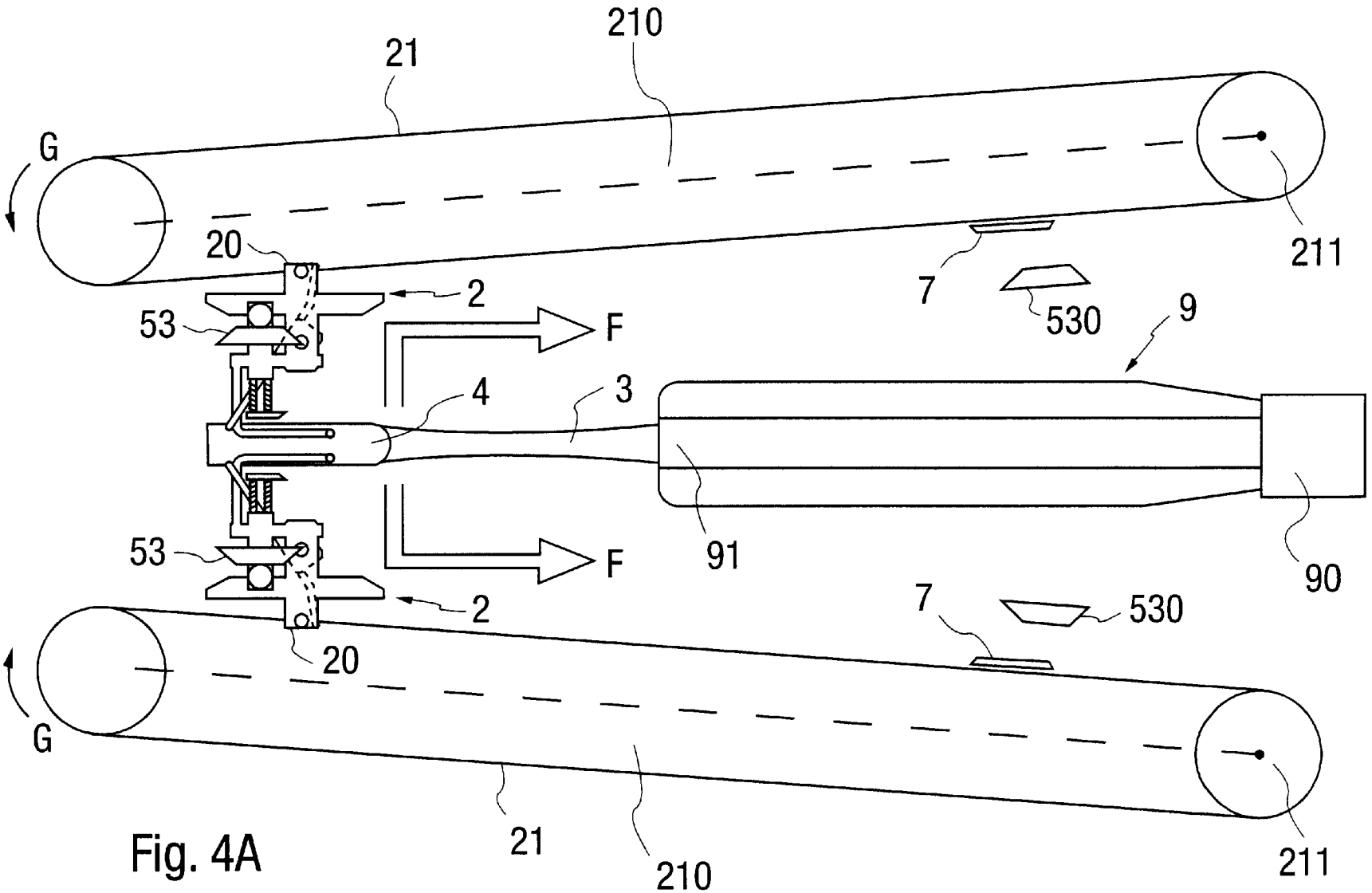
FIG. 4A is a general schematic representation of the apparatus, according to the invention, as viewed in the condition of FIG. 1A.
Figure 4B:
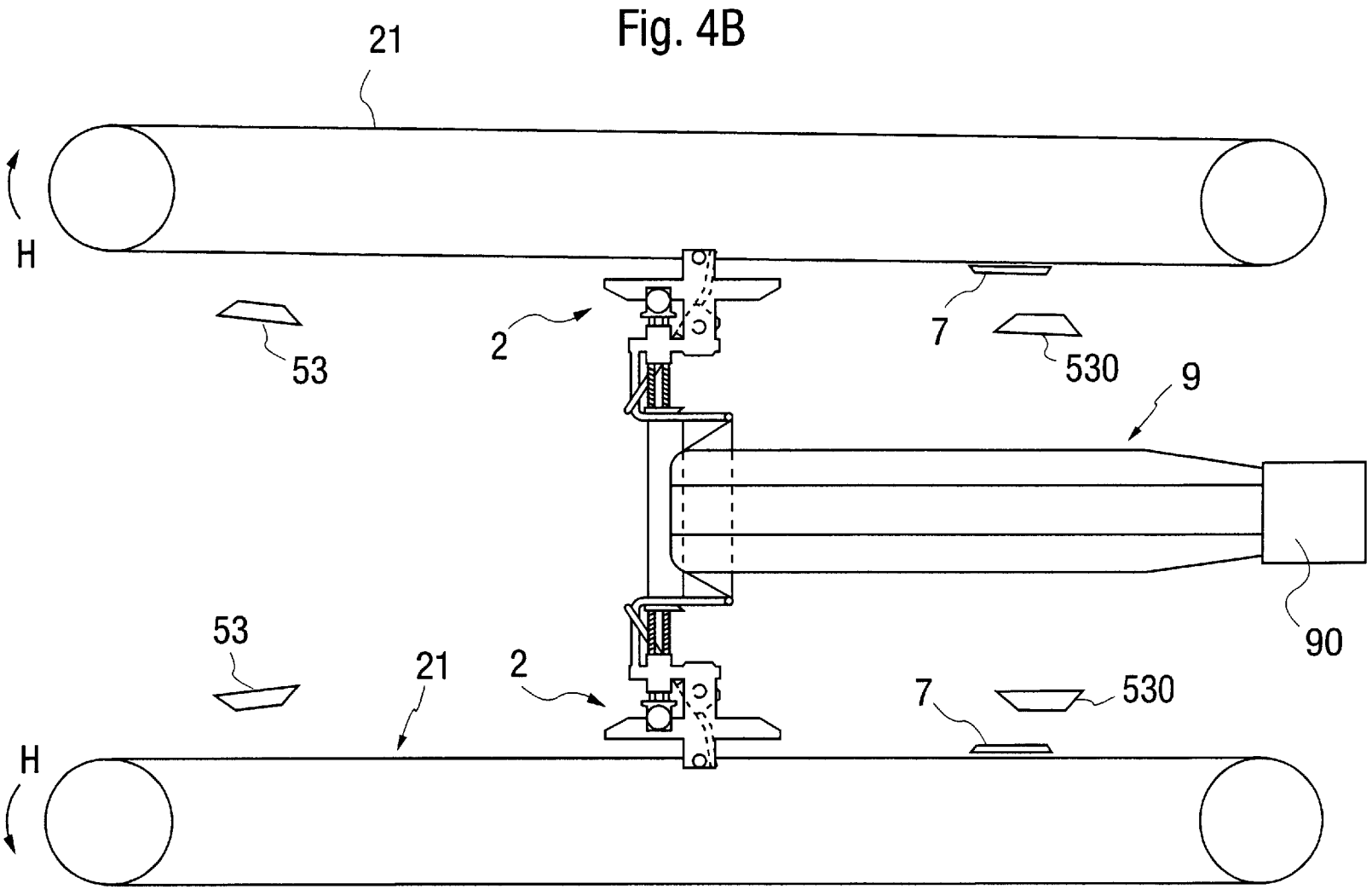
FIG. 4B is a view similar to that of FIG. 4A, with the apparatus in the condition of FIG. 2A.

The command enabling the opening of each gripper 1, 5 is performed by sliding a roller 51, which is solid to the body 52 and positioned diametrically opposite to the latter, onto a fixed cam 53 located in correspondence of the retractor 4 and suitably shaped to achieve—with the carriages 2 being moved close to the retractor 4, as illustrated in FIG. 4A—the withdrawal of the presser 5 from the horizontal portion 11 of the respective element 1. The same command can be given upon the step for the release of the elastic hem 30 of the stocking 3, by means of a relevant cam 530 suitably located at the position, in front, of the station for the release of articles.

A rotation device is arranged on the transport body for rotating the portion of the article about a fold axis when the transport body and the article are at the station for the release of articles. The rotation device includes a rotation body 6 mounted on each of the carriages 2 and is angularly oscillatable about an axis 60 orthogonal to the direction F of advancement of the stocking 3. The oscillation axis 60 of the rotation body 6 is in correspondence of an appendix 21 of the relevant carriage 2. The rotation body 6 is associated to spring means 63, intended to counteract its oscillation about the axis 60. The rotation body 6 includes a front portion 61 facing the article 3 under treatment, and a rear portion 62 facing the opposite side. The front portion 61 of the rotation body 6 is intended to engage the elastic hem 30 of the stocking 3, in order to push it forward upon the stage for unloading or releasing the latter—as explained in more details later on.

Figure 3A:
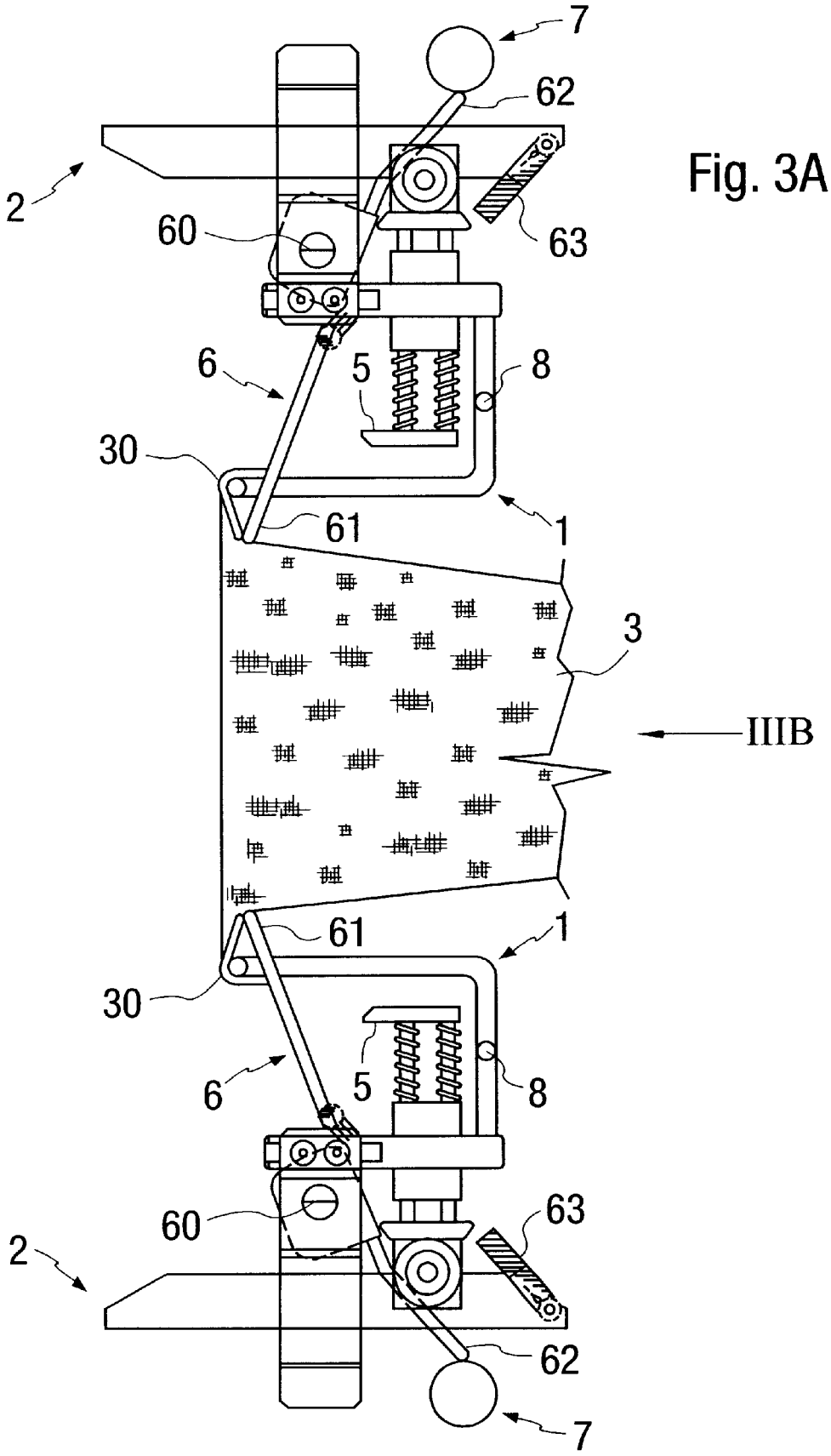
FIG. 3A is a view of the apparatus of the preceding figures as it releases or unloads the stocking.
Figure 3B:
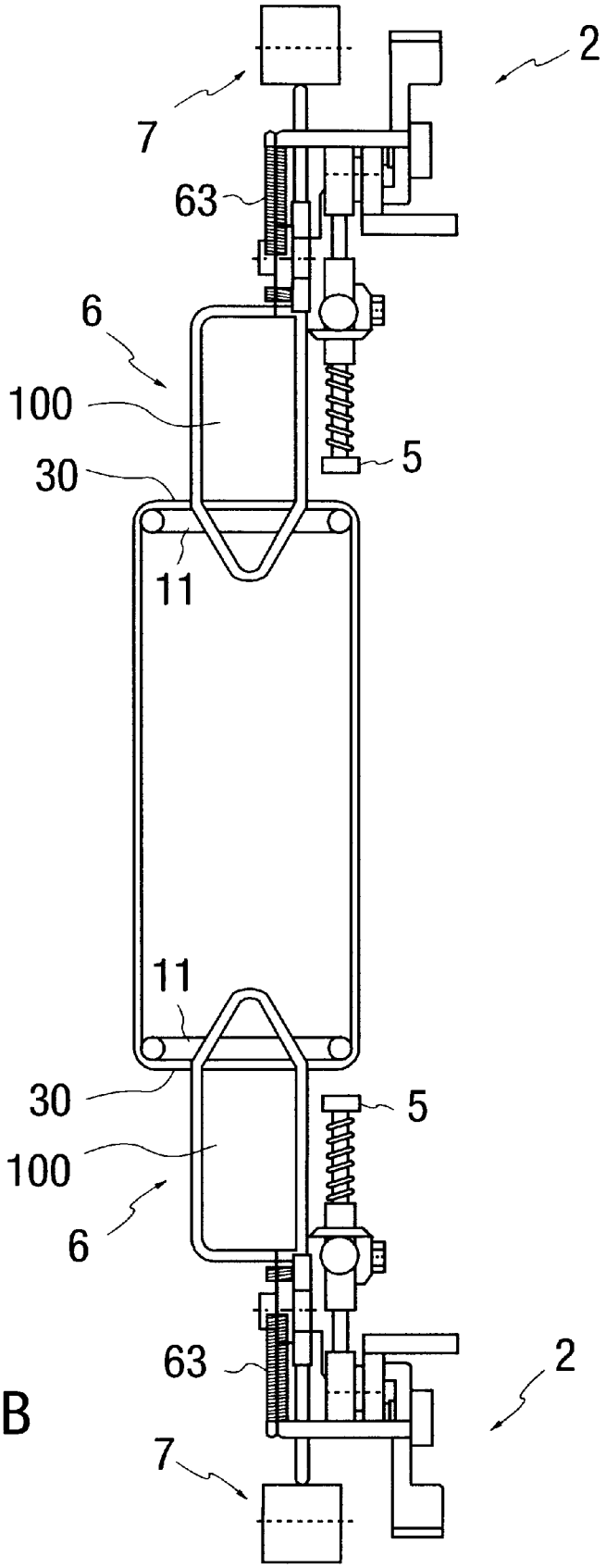
FIG. 3B is a view from "IIIB" of the apparatus of FIG. 3A.
Figure 4C:
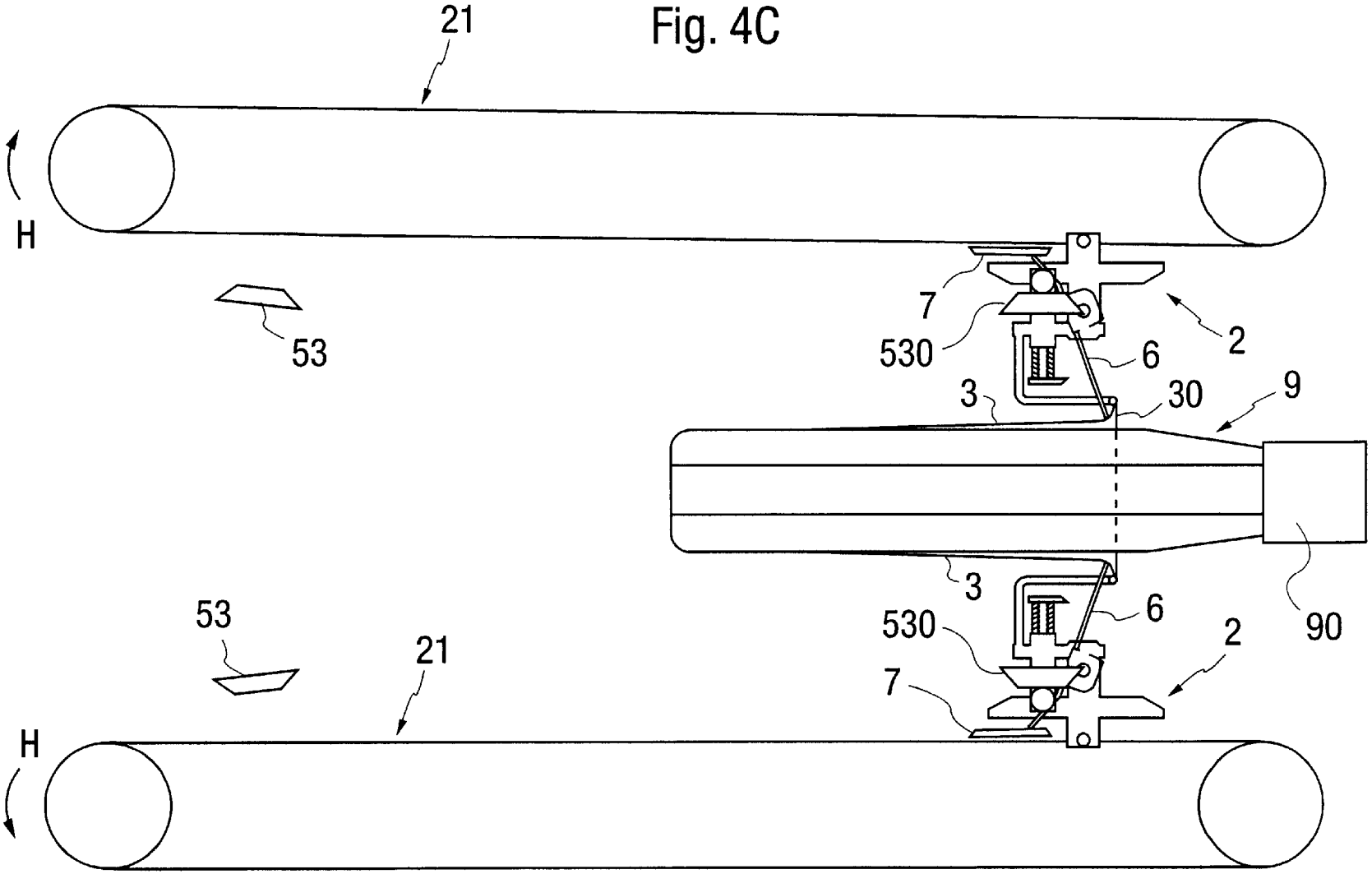
FIG. 4C is a view similar to that of FIG. 4A, with the apparatus in the process of releasing the stocking.
Figure 4D:
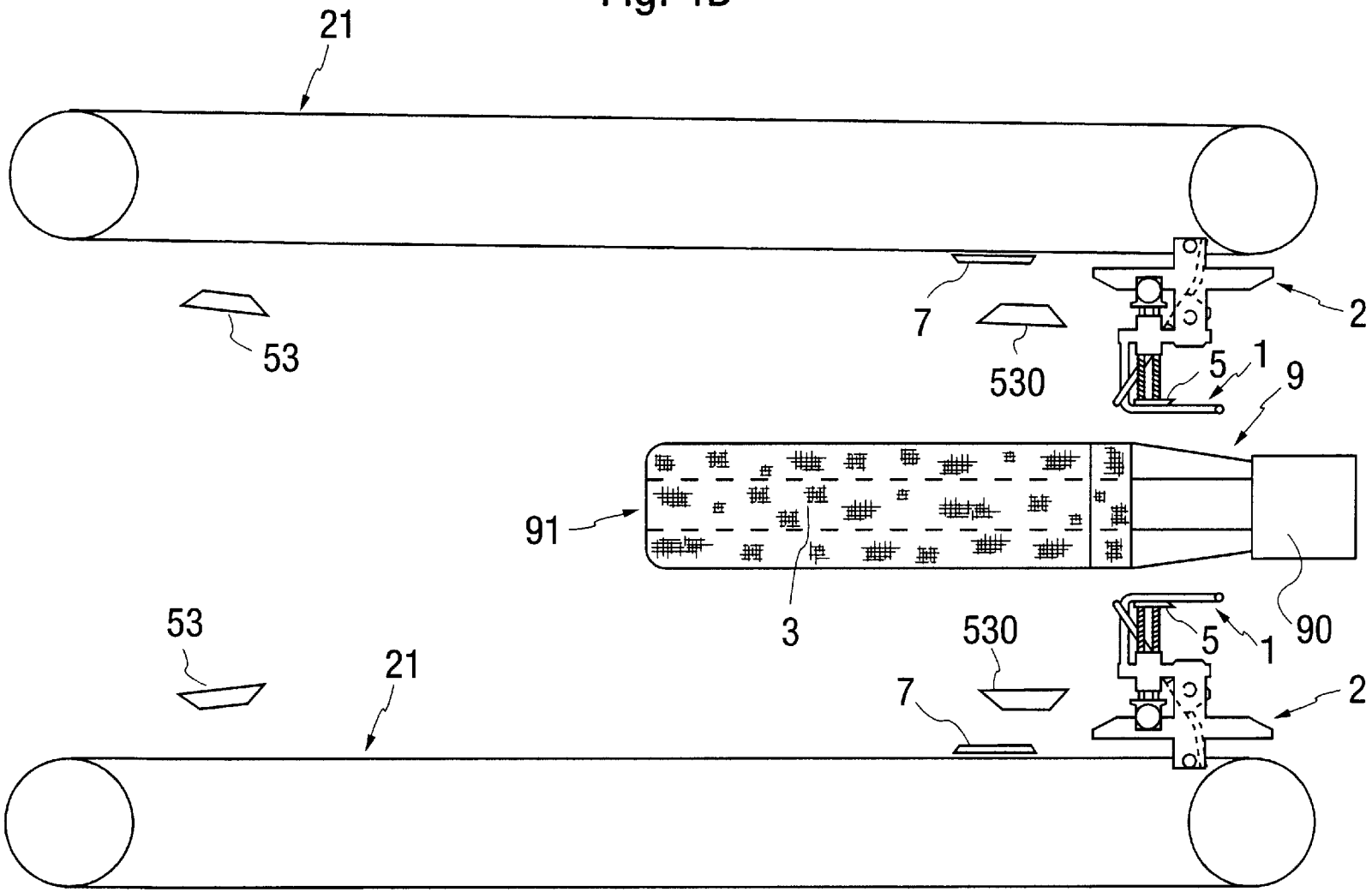
FIG. 4D is a view similar to that of FIG. 4A, with the apparatus having a configuration taken up after the step of FIG. 4C.

The rear portion 62 of the rotation body 6 is intended to interact with a fixed cam 7 in correspondence of the station for the unloading of the articles as illustrated in FIGS. 3A and 4C to drive the front portion 61 into rotation about the axis 60 and thus move forward the front end 61 thereof. The elastic means 63 acting on the body 6 ensures that the front portion 61 of the latter will result rotated forward and will engage the elastic hem 30 of the stocking 3 only in correspondence of the step for the release thereof. Provided on the vertical portion 10 of each of the engagement elements 1 is a pin 8 limiting the backward stroke of body 6 resulting from the return action exerted by the spring means 63.

Figure 2B:
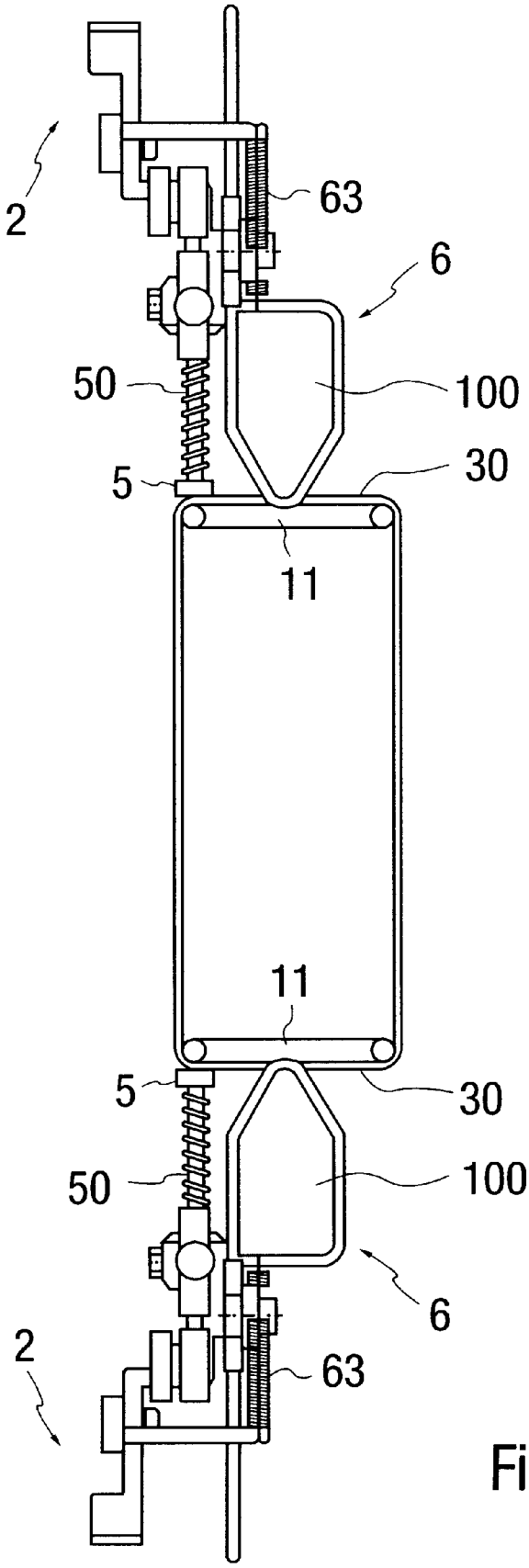
FIG. 2B is a view from "IIB" of the apparatus of FIG. 2A.

Advantageously, according to the invention, the front portion 61 of the body 6 has a substantially pentagonal profile 100, as shown in FIG. 2B with a vertex facing the area of action of the relevant engagement element 1.

The body 6 may consist, as illustrated in the figures of the accompanying drawings, of a single, filiform element having a suitable profile.

The procedure according to the invention includes the following operating steps:

- picking up each stocking 3 to be treated by holding its elastic hem 30 with gripper means 1, 5;
- moving the stocking 3, with the elastic hem 30 thus engaged, in a predetermined F direction of advancement up to an unloading station in which the elastic hem 30 is disengaged from the gripper means 1, 5;
- engaging and pushing forward, in correspondence of the unloading station, the elastic hem so as to cause it provided it is folded up, that is, bent about an axis u—u to rotate about the axis u—u and move forward.

The operation of the above described apparatus is as follows.

The loading of the stocking 3 onto the segment 4 may be carried out either manually or automatically by a pneumatic feeder of known type which disposes the stocking with the portion of its elastic hem 30 facing forward and with the toe portion being aspirated into a hose 9 of a toe closer machine. A part 90 of the toe closer machine which supports the hose 9 can be seen in FIGS. 4A–4D.

Once the elastic hem 30 of the stocking 3 is fitted on the retractor 4, the retractor 4 is activated to cause it to be stretched apart. In this way, the elastic hem 30 of the stocking 3 results in a condition suitable for the insertion of the portions 11 of engagement elements 1 through the elastic hem 30. This insertion is operated by moving the carriages 2 close to the retractor 4, as illustrated in FIG. 4A, and by operating the relevant chains 21 so as to cause the translation of carriages 2 in the direction of arrows F. Upon completion of this operation, during which the grippers 1, 5 are open, the arms 210 are rotated about the relevant axes 211 as indicated by the arrows H in FIG. 4B.

Under this condition, the roller 51 of each buffer 5 does not interfere any longer with the respective cam 53, so that the elastic hem 30 will be compressed between the buffers 5 and the horizontal portions 11 of the two elements 10. The subsequent simultaneous translation of carriages 2, in the direction indicated by the arrows F, implies the progressive turning inside out of the stocking 3 on the hose 9, as the toe portion is retained within the suction mouth 91 of the hose 9. In correspondence of the station for the unloading of the stocking 3, the interaction between the rollers 51 of the two carriages 2 and relevant cams 530 causes the two gripper units 1, 5 to open again. Under this condition, the elastic hem 30 of stocking 3 will be free. The forward rotation of the bodies 6 about the respective axes 60 will cause corresponding forward rotation of the stocking's elastic hem 30 about the fold axis u—u due to the forward thrust thus exerted on the hem 30 by the front portion 61 of the bodies 6. In this way, there is achieved the final transfer of the stocking 3 to the hose 9 of the toe-closer, with the elastic hem 30 being in a perfectly stretched attitude. At this point, the hose 9 having the stocking loaded thereon with its elastic hem 30 thus stretched, is moved by the relevant driving means of the toe-closer machine, to a position suitable for the sewing of the toe or for further operations prior to performing the sewing, and then its place is taken up by another hose to be loaded according to the above described procedures.

The cycle described above is performed without any interruption, however, if deemed necessary, it can be carried out in more separate stages in correspondence of one or more of which, the system is suitably stopped.

According to a further embodiment of the invention, the body means 6 may be positioned in correspondence of the station for the unloading of articles 3, independently of carriages 2, in order to operate according to the previously indicated procedures, except for their being driven or activated by corresponding actuators provided at the unloading station.

It is understood that the method and apparatus of the present invention are applicable not only to the loading of hoses of a toe-closer machine for hosiery articles, but also to the loading of shapes of a pantyhose-sewing machine or "line-closer" and, more generally, to the removal, handling and unloading of textile articles of other type which are to be treated as to obtain the unloading thereof while their portion engaged by removal and handling means is in a stretched condition.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While specific embodiments of the invention have been shown and described in detail to illustrate the application of the principles of the invention, it will be understood that the invention may be embodied otherwise without departing from such principles.

What is claimed is:

1. An apparatus for handling tubular textile articles, comprising; removal and handling means to engage a portion of same articles in a station for the removal thereof and to operate the handling thereof in a predetermined direction up to a station for either the unloading or the release thereof; movement means acting between said removal and handling means and said article portion engaged by the latter, in order to move said article portion forward by rotating it in said predetermined direction about a respective fold axis, said movement means being in an active condition in correspondence of the unloading of the articles and, respectively, in a rest condition in correspondence of the removal and handling thereof.

2. The apparatus according to claim 1, wherein said means for the removal and handling of the articles comprise two grippers mounted on corresponding carriages able to move in said direction and being positioned and acting on opposite sides with respect to the portion of the article to be engaged.

3. The apparatus according to claim 1 wherein said means for operating the forward rotation of the portion of the article about said fold axis are associated to means for the removal and handling of the articles.

4. The apparatus according to claim 2, wherein said means for driving the portion of the article into forward rotation about said fold axis are borne by said carriages and comprise, for each carriage, a body angularly oscillating about an axis orthogonal to the direction of advancement of the tubular article; said body being associated to spring means to counteract the oscillation thereof about said axis and exhibiting a front portion facing the region of the article to be treated, and a rear portion facing the opposite side and intended to interfere with a corresponding cam in correspondence of said station for the unloading of the articles in order to operate the forward rotation of the body, that is, of the respective front portion thereof, so as to force said portion of the articles to rotate about the respective fold axis owing to the interaction between said portion of body and said portion of articles.

5. The apparatus according to claim 2, wherein said carriages are engaged to two corresponding chains each of which is ring-like closed on a relevant arm angularly oscillating about an axis orthogonal to the direction of advancement of the articles.

6. The apparatus according to claim 1, wherein the front portion of said movement means has a substantially pentagonal profile.

7. The apparatus according to claim 4, wherein said carriages are engaged to two corresponding chains each of which is ring-like closed on a relevant arm angularly oscillating about an axis orthogonal to the direction of advancement of the articles.

8. The apparatus according to claim 4, wherein the front portion of said movement means has a substantially pentagonal profile.

* * * * *